US005570750A

United States Patent [19]

Williams

[11] Patent Number: 5,570,750

[45] Date of Patent: Nov. 5, 1996

[54] ROTARY DRILL BIT WITH IMPROVED SHIRTTAIL AND SEAL PROTECTION

[75] Inventor: Mark E. Williams, Grand Prairie, Tex.

[73] Assignee: Dresser Industries, Inc., Dallas, Tex.

[21] Appl. No.: 425,917

[22] Filed: Apr. 20, 1995

[51] Int. Cl.[6] ..... E21B 10/00

[52] U.S. Cl. ..... 175/371

[58] Field of Search ..... 175/371, 372, 175/369, 331, 337, 339

[56] References Cited

U.S. PATENT DOCUMENTS

| | | | |
|---|---|---|---|
| 3,663,073 | 5/1972 | Bronson | 308/8.2 |
| 4,037,673 | 7/1977 | Justman | 175/371 |
| 4,179,003 | 12/1979 | Cooper et al. | 175/371 |
| 4,183,417 | 1/1980 | Levefelt | 175/339 |
| 4,190,301 | 2/1980 | Lachonius et al. | 308/8.2 |
| 4,199,156 | 4/1980 | Oldham et al. | 277/92 |
| 4,252,330 | 2/1981 | Crow | 277/92 |
| 4,290,497 | 9/1981 | Barnetche | 175/371 |
| 4,298,079 | 11/1981 | Norlander et al. | 175/339 |
| 4,613,004 | 9/1986 | Shotwell | 175/371 |
| 4,613,005 | 9/1986 | Olsson | 175/371 |
| 4,666,001 | 5/1987 | Burr | 175/371 |
| 4,671,368 | 6/1987 | Burr | 175/371 |
| 4,762,189 | 8/1988 | Tatum | 175/371 |
| 4,765,205 | 8/1988 | Higdon | 76/108 |
| 4,825,964 | 5/1989 | Rives | 175/371 |
| 4,903,786 | 2/1990 | Welsh | 175/367 |
| 4,981,182 | 1/1991 | Dysart | 175/371 X |
| 5,005,989 | 4/1991 | Karlsson | 175/371 X |
| 5,080,183 | 1/1992 | Schumacher et al. | 175/371 |
| 5,137,097 | 8/1992 | Fernandez | 175/371 X |
| 5,358,061 | 10/1994 | Van Nguyen | 175/371 |
| 5,429,200 | 7/1995 | Blackman et al. | 175/371 |

*Primary Examiner*—William P. Neuder
*Attorney, Agent, or Firm*—Baker & Botts, L.L.P.

[57] ABSTRACT

A rotary cone drill bit for forming a borehole having a bit body with an upper end portion adapted for connection to a drill string. A number of angularly-spaced support arms formed to extend from the bit body. Each support arm has an inside surface with a spindle connected thereto and an outer shirttail surface. A number of cutter cones equal to the number of support arms are rotatably mounted on respective spindles. Each of the cutter cones includes an internal cylindrical cavity for receiving the respective spindle. A gap with a generally cylindrical portion is formed between the spindle and the cavity with a seal element disposed within the gap. The gap has an opening contiguous with the bottom edge of the shirttail surface and extending outwardly from the spindle. A shirttail ring is disposed on the exterior of each spindle between the cutter cone and the inside surface of the respective support arm with a portion of the shirttail ring extending from the respective shirttail surface. A seal ring may be disposed on the exterior of the spindle adjacent to the shirttail ring. The seal ring cooperates with the sealing element to form a fluid barrier between the spindle and the cavity.

20 Claims, 5 Drawing Sheets

ROTARY DRILL BIT WITH IMPROVED SHIRTTAIL AND SEAL PROTECTION

RELATED APPLICATION

This application is related to copending U.S. patent application Ser. No. 08/221,841 filed Mar. 31, 1994, entitled *Rotary Drill Bit with Improved Cutter and Seal Protection* (Attorney's Docket 060220.0123); copending U.S. patent application Ser. No. 08/221,371 filed Mar. 31, 1994, entitled *Rotary Drill Bit With Improved Cutter and Method of Manufacturing Same* (Attorney Docket 060220.0117); copending U.S. patent application Ser. No. 08/299,821 filed Aug. 31, 1994, entitled *Flat Seal for a Roller Cone Rock Bit* (Attorney's Docket 060220.0154); and copending U.S. patent application Ser. No. 08/299,485 filed Aug. 31, 1994, entitled *Compression Seal for a Roller Cone Rock Bit* (Attorney's Docket 060220.0156).

TECHNICAL FIELD OF THE INVENTION

This invention relates in general to rotary cone drill bits used in drilling a borehole in the earth and in particular to enhanced shirttail protection to minimize erosion of sealing surfaces and bearing surfaces associated with a cutter cone and a spindle on which the cutter cone is rotatably mounted.

BACKGROUND OF THE INVENTION

One type of drill used in forming a borehole in the earth is a roller cone drill bit. A typical roller cone bit comprises a bit body with an upper end adapted for connection to a drill string. Depending from the lower portion of the bit body are a plurality of support arms, typically three, each with a spindle protruding radially inward and downward with respect to a projected rotational axis of the bit body. A cutter cone is generally mounted on each spindle and supported rotatably on bearings acting between the spindle and the inside of a spindle-receiving cavity in each cutter cone. One or more fluid nozzles are often formed on the underside of the bit body. The nozzles are typically positioned to direct drilling fluid passing downwardly from the drill string toward the bottom of the borehole being drilled. Drilling fluid washes away material removed from the bottom of the borehole and cleanses the cutter cones, carrying the cuttings and other debris radially outward and then upward within an annulus defined between the drill bit and the wall of the borehole.

Protection of bearings which allow rotation of the cutter cones can lengthen the useful service life of a drill bit. Once drilling debris is allowed to infiltrate between bearing surfaces of the cutter cone and spindle, failure of the drill bit will follow shortly. Various mechanisms have been employed to help keep debris from entering between the bearing surfaces. A typical approach is to place an elastomeric seal across a gap between the bearing surfaces of each cutter cone and its respective spindle support arm. However, once the seal fails, it is not long before drilling debris contaminates the bearing surfaces via the gap between the cutter cone and its respective spindle. Thus, it is important that each seal also be protected against wear caused by debris in the borehole.

Various approaches have previously been employed to protect seals in drill bits from debris in the well bore. One approach is to provide hardfacing and wear buttons on opposite sides of the gap between each spindle support arm and the respective cutter cone where the gap opens to the exterior of the drill bit and is exposed to debris-carrying well fluid. Hardfacing and wear buttons slow erosion of the metal adjacent to the gap, and thus prolonging the time before the respective seal is exposed to borehole debris. Another approach is to construct inner-fitting parts of the cutter cone and the spindle support arm to produce a tortuous path within each gap leading to the respective seal which is difficult for debris to follow. Examples of drill bits with seal protection features are disclosed in U.S. Pat. Nos. 4,613,004 entitled *Earth Boring Bit with Labyrinth Seal Protector,* and 4,037,673 entitled *Roller Cutter Drill Bit.*

An example of the first approach is used in a conventional tri-cone drill bit wherein the base of each cutter cone at the juncture with the respective spindle and support arm is defined at least in part by a substantially frustoconical surface, termed the cutter cone gage surface. This cutter cone gage surface is slanted in an opposite direction as compared to the conical surface of the shell or nose of the respective cutter cone and often includes hardfacing, a plurality of hard metal buttons or surface compacts. The latter are designed to reduce the wear of the frustoconical portion of the cutter cone gage surface at one side of the gap. On the other side of the gap, the lower portion of the respective support arm is protected by hardfacing material. For definitional purposes, the lower portion of the support arm located on the exterior of the associated drill bit below the nozzles is often referred to as a shirttail surface or simply shirttail. More specifically, in referring to prior art drill bits, radially outward of the juncture of each spindle with its respective support arm, and toward the exterior of the drill bit, the lower edge or extreme lower portion of the shirttail is referred to as the tip of the shirttail or shirttail tip.

During drilling with rotary cone drill bits of the foregoing character, debris often passes between the cutter cone gage surface and the wall of the borehole generally within the area where the gap opens to the borehole annulus. As a result, the edge of the shirttail tip of each support arm which leads in the direction of rotation of the drill bit during drilling, i.e., the leading edge, can become eroded. As this erosion progresses, the hardfacing covering the respective shirttail tip eventually erodes or chips off. This erosion exposes underlying softer metal to increased erosion and thereby shortens the path that debris may take through the gap to the respective seal and ultimately exposes the respective seal to borehole debris causing seal failure and ultimately bearing failure.

Generally, the shirttail tip of a conventional support arm is relatively thin and does not allow application of hardfacing in sufficient quantities to provide adequate protection from erosion. Also, tungsten carbide inserts must be located away from the thin shirttail tip to accommodate clearance and material strength requirements for press fit installation. Depending upon specific downhole drilling conditions and design geometry of the respective rotary cone drill bit, the thin shirttail tip of the respective support arms may be a weak point leading to failure of the associated drill bit.

SUMMARY OF THE INVENTION

In accordance with the present invention, disadvantages and problems associated with previous rock bits and rotary cone drill bits have been substantially reduced or eliminated. One aspect of the present invention includes providing a stronger, more abrasion resistant shirttail ring which will contribute to increased protection from erosion and longer downhole drilling time for the associated drill bit. Another aspect of the present invention includes providing a seal ring with an enhanced sealing surface to reduce wear between the associated seal and the sealing surface. For some applications the shirttail ring and the seal ring may be separate components. For other applications the shirttail ring and the seal ring may be formed as a single unit. The use of a shirttail ring in accordance with the teachings of the present invention will substantially reduce and better protect the gap formed between each cutter cone and its respective support arm and spindle from erosion by downhole fluids and borehole debris.

A further aspect of the present invention includes providing a support arm and cutter cone assembly for a rotary cone drill bit with superior erosion protection. For one application each support arm may be integrally formed with its associated bit body with an inner surface, a shirttail surface, and a bottom edge. The inner surface and the shirttail surface of each support arm are contiguous at the bottom edge. A spindle is attached to the respective inner surface and angled downwardly with respect to each support arm. The support arm and cutter cone assembly also includes a cutter cone having a cavity with an opening for receiving the respective spindle. Each support arm and cutter cone assembly further includes a seal for forming a fluid barrier within a gap formed between the interior of the cavity and the exterior of the spindle. Each gap also has an opening contiguous with the bottom edge of the respective support arm and in communication with any fluids or debris on the exterior of the drill bit.

Technical advantages of the present invention include providing shirttail rings which can be manufactured as separate components from hard, abrasion resistant materials with increased consistency and reliability while at the same time reducing manufacturing costs. Shirttail rings incorporating teachings of the present invention may be used to eliminate or substantially reduce problems associated with placement of hardfacing and/or tungsten carbide inserts on the thin shirttail area associated with conventional support arms. Thus, the present invention results in both improved downhole performance and reliability of the resulting drill bit while at the same time reducing manufacturing costs.

In another aspect of the present invention, erosion protection is provided for the respective support arm and cutter cone assembly by providing both a shirttail ring and a seal ring formed as two separate components. The shirttail ring may be formed from carbide chips or other suitable materials such as cast carbide and hard steel, sintered tungsten carbide, or tungsten carbide powder and a suitable binder to provide a much harder, wear resistant surface as compared to the prior shirttail surfaces. The seal ring may be formed from much less abrasive materials and treated by various processes such as nitrating to increase its wear resistance while at the same time providing the desired smooth sealing surface to form a fluid tight barrier and increase seal life. Enhanced erosion protection is further achieved by shortening the associated shirttail tip and increasing its thickness.

Further technical advantages of the present invention include forming a shirttail ring and/or a seal ring using manufacturing techniques and materials which are normally incompatible with each other under the usual processing steps associated with the manufacture of rotary cone drill bits. Specifically, the shirttail ring may be formed from a hard metal and/or composite materials that are more resistant to erosion and wear than conventional hardfacing materials and fabricated by techniques incompatible with the usual machining and heat-treating processes associated with the respective support arm. Thus, the thin shirttail tip associated with conventional support arms may be replaced by a shirttail ring in accordance with the teachings of the present invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiments of the present invention and its advantages are best understood by referring to FIGS. 1–8 of the drawings, like numerals being used for like and corresponding parts of the various drawings.

Figure 1:
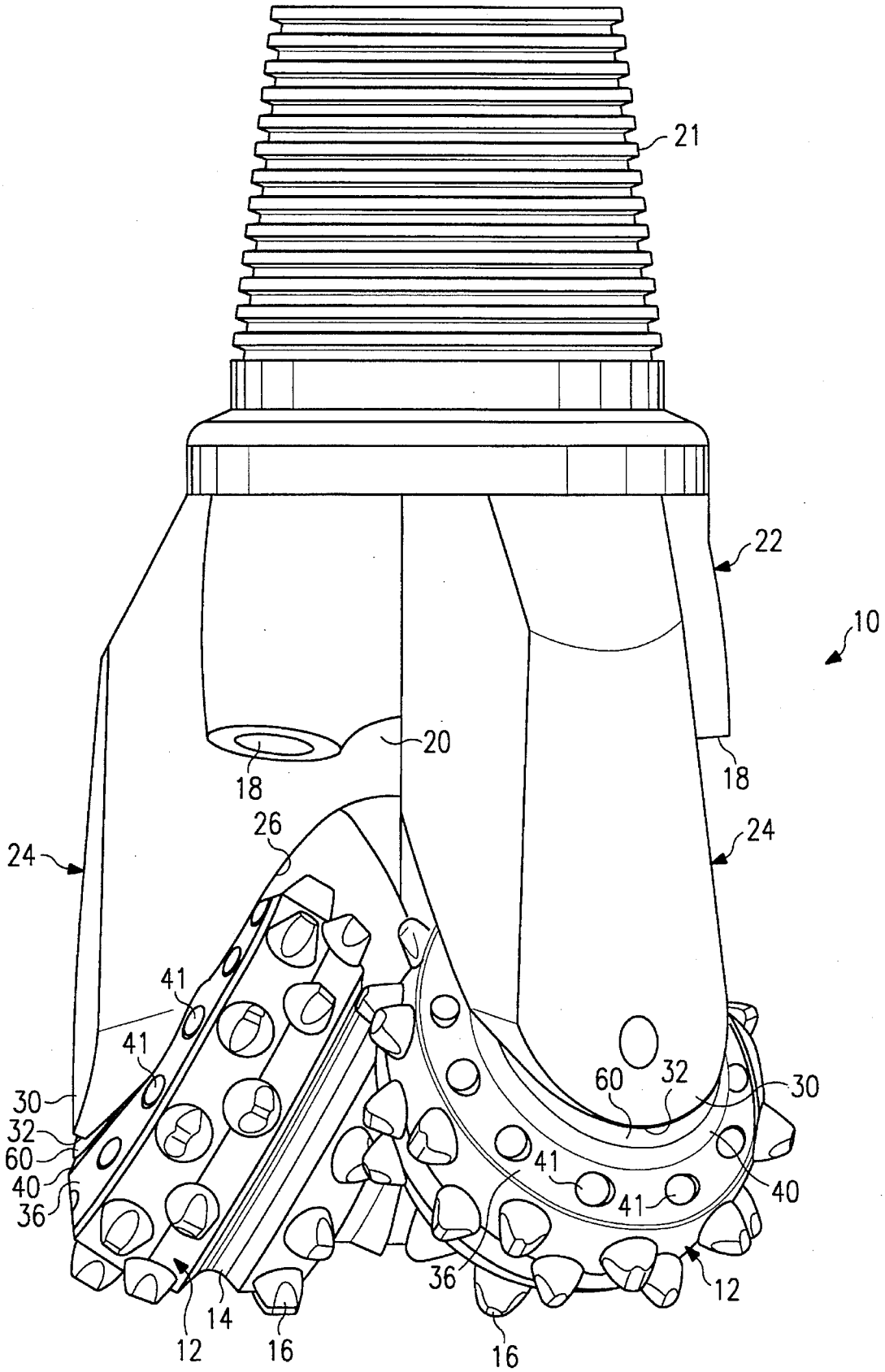
FIG. 1 is an isometric view of a rotary cone drill bit incorporating one embodiment of the present invention.

For purposes of illustration, FIG. 1 shows one embodiment of the present invention represented by rotary cone drill bit 10 of the type used in drilling a borehole (not shown) in the earth. Rotary cone drill bit 10 may sometimes be referred to as a "rotary rock bit." With rotary cone drill bit 10, cutting action occurs as cone-shaped cutters 12 are rolled around the bottom of the borehole by rotation of a drill string (not shown) to which drill bit 10 is attached. Cutter cones 12 may sometimes be referred to as "rotary cutter cones" or "roller cutter cones" or "cone cutters."

As shown in FIG. 1, cutter cones 12 each include cutting edges formed by grooves 14 and protruding inserts 16 which scrape and gouge against the sides and bottom of a borehole under weight applied through a drill string. The downhole drilling debris thus created is carried away from the bottom of the borehole by drilling fluid ejected from nozzles 18 on underside 20 of drill bit 10. The debris-carrying fluid generally flows radially outward between underside 20 of drill bit 10 and the borehole bottom, and then flows upwardly toward the well head (not shown) through an annulus (not shown) defined between the exterior of drill bit 10 and the inside wall (not shown) of the borehole.

Rotary cone drill bit 10 comprises an enlarged bit body 22 with a tapered, externally-threaded upper section 21 adapted to be secured to the lower end of a drill string. Depending from bit body 22 are three support arms 24. Only two support arms 24 are visible in FIG. 1. Each support arm 24 preferably includes inside surface 26 with spindle 28 extending therefrom. See FIGS. 2, 3 and 4.

The lower portion of each support arm 24 preferably includes an outer surface or shirttail surface 30. Inside surface 26 and shirttail surface 30 are contiguous with each other at bottom edge 32 of each support arm 24. Spindles 28 are preferably angled downwardly and inwardly with respect to longitudinal axis 23 of bit body 22 so that as drill bit 10 is rotated, the exterior of each cutter cone 12 engages the bottom of the borehole. For some applications, spindles 28 may also be tilted at an angle of zero to three or four degrees in the direction of rotation of drill bit 10.

Each cutter cones 12 may be constructed and mounted on its associated spindle 28 in a substantially identical manner except for the respective pattern of the rows of inserts 16. Accordingly, only one support arm 24 and cutter cone 12 is described in detail, since the same description applies generally to the other support arm and assemblies.

Figure 2:
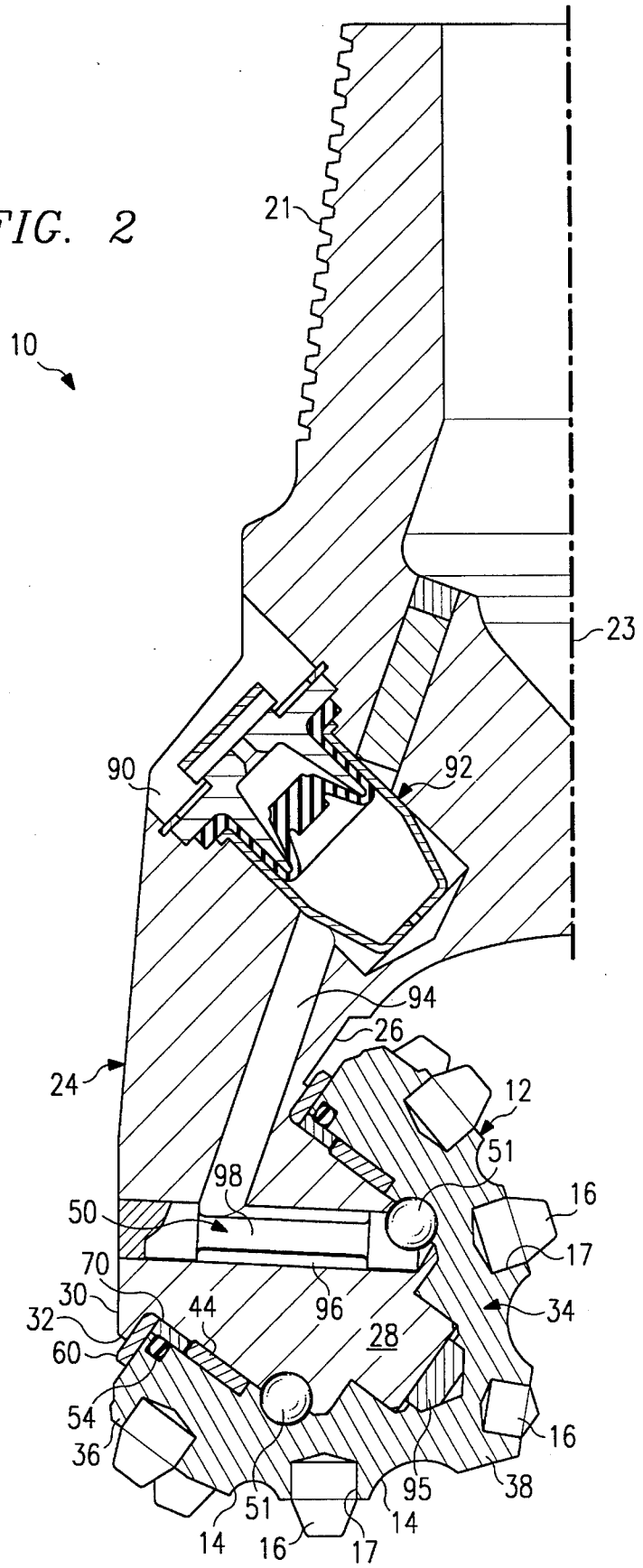
FIG. 2 is a drawing in section with portions broken away showing a support am and cutter cone assembly associated with the rotary cone drill bit of FIG. 1.
Figure 3:
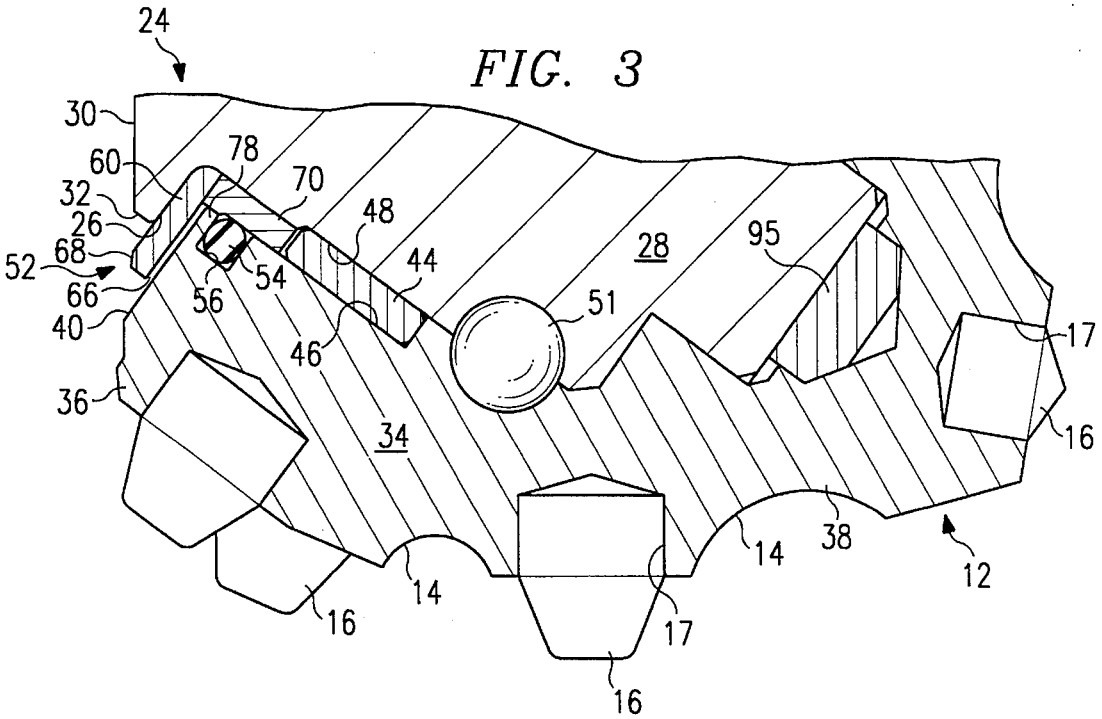
FIG. 3 is an enlarged drawing in section with portions broken away showing a portion of the support arm and cutter cone assembly of FIG. 2.
Figure 4:
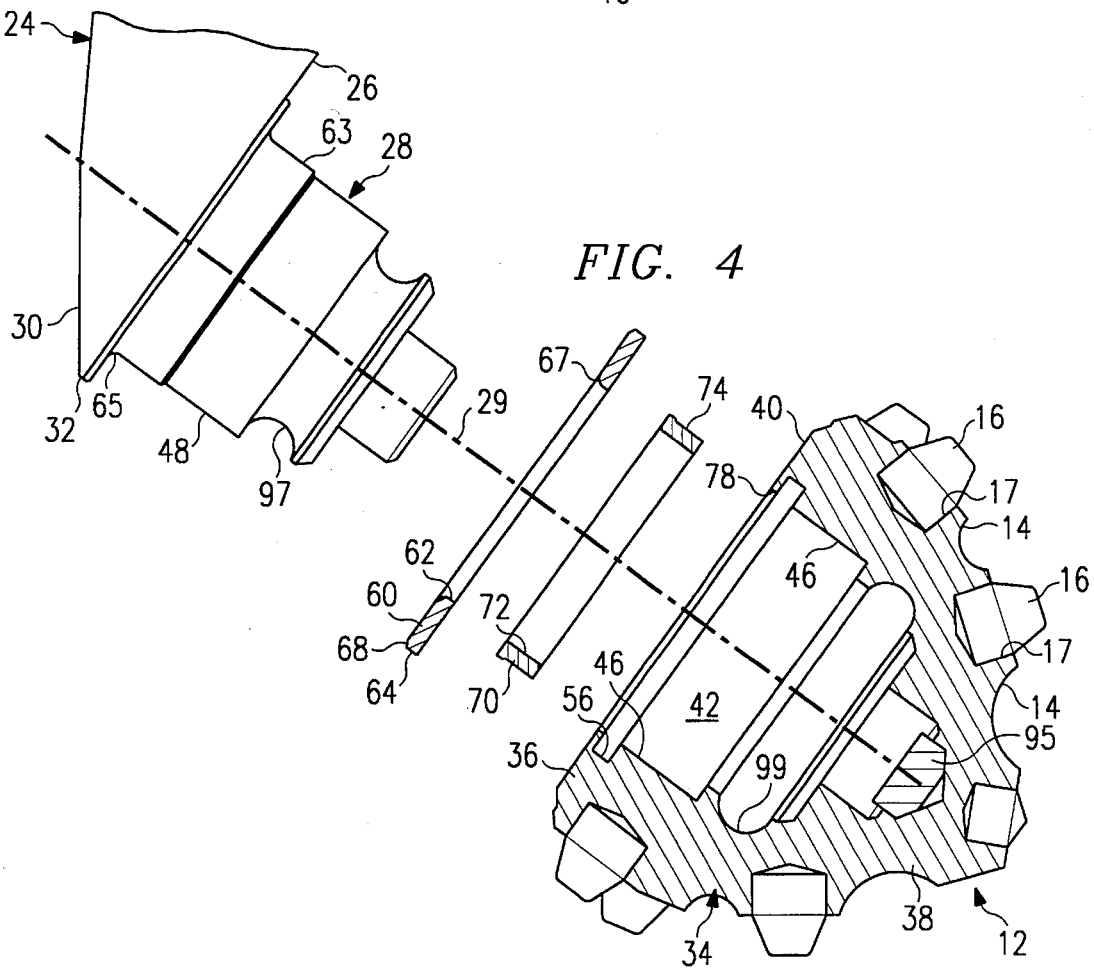
FIG. 4 is an exploded drawing partially in section and partially in elevation showing selected portions and components of the support arm and cutter cone assembly of FIG. 2.

As shown in FIGS. 2–4, inserts 16 are mounted within respective sockets 17 formed in cutter cone body 34. Cutter cone body 34 includes base portion 36 and nose 38 extending therefrom. Base portion 36 preferably includes backface surface 40 which extends radially relative to central axis 29 of spindle 28. When cutter cone 12 is mounted on spindle 28, backface surface 40 will be aligned substantially parallel with adjacent portions of inside surface 26 on support arm 24. For some applications as show in FIG. 1, pressed inserts and/or surface compacts 41 may be provided in base portion 36 to minimize or prevent erosion and wear of the respective cutter cones 12.

Opening inwardly from backface surface 40 is a generally cylindrical cavity 42 for receiving spindle 28. A suitable bearing 44 is preferably mounted on spindle 28 between bearing wall 46 of cavity 42 and annular bearing surface 48 on spindle 28. A conventional ball retaining system 50 secures cutter cone 12 to spindle 28.

For the embodiment shown in FIG. 2, support arm 24 includes lubricant cavity 90, lubricant pressure compensation system 92 and lubricant passage 94 to provide the desired lubricant to various components associated with cutter cone 12 and spindle 28. One or more passageways (not shown) may be provided within spindle 28 to provide lubricant to ball retainers 51, bearing 44 and/or seal element 54 as desired for anticipated downhole conditions. Thrust button 95 may be provided within cavity 42 for engagement with the extreme end of spindle 28. Lubricant may also be supplied to thrust button 95 if desired for the specific downhole application. The enhanced shirttail and seal protection offered by the present invention may be used with a wide variety of support arm and cutter cone assemblies having various types of lubricating systems including systems associated with air drilling. The present invention is not limited to use with support arms and cutter cones assemblies having the lubricating system shown in FIG. 2.

Ball retaining system 50 includes ball passageway 96. Cutter cone 12 is retained on spindle 28 by inserting a plurality of ball bearings 51 through ball passageway 96. Ball bearings 51 reside in an annular array within cooperatively associated ball races 97 and 99 formed in the exterior of spindle 28 and the interior of cavity 42 respectively. Once inserted, ball bearings 51 prevent the disengagement of cutter cone 12 from spindle 28. Ball passageway 96 is subsequently plugged with ball plug 98 using conventional techniques. Again, the enhanced shirttail and seal protection features of the present invention may be used with a wide variety of support arm and cutter cone assemblies and is not limited to use with a support am and cutter cone assembly having ball retaining system 50 as shown in FIG. 2.

Spindle 28 has a generally cylindrical exterior surface and cavity 42 has a generally cylindrical interior surface. To allow cutter cone 12 to be rotatably mounted on spindle 28 the outside diameter of spindle 28 is less than the inside diameter of the adjacent portion of cavity 42. Thus, a generally cylindrical gap is formed between the exterior of spindle 28 and the interior of cavity 42. The various segments of the resulting gap are defined by adjacent surfaces of spindle 28 and cavity 42 such as bearing surfaces 46 and 48 and ball races 97 and 99. As shown in FIG. 3, outer segment 52 of the gap extends radially outward from the exterior of spindle 28 between backface surface 40 of cutter cone body 34 and the adjacent portions of inside surface 26 on support arm 24. Outer segment 52 includes an opening between bottom edge 32 of shirttail surface 30 and backface surface 40. Shirttail ring 60 is disposed within this opening. A fluid tight barrier is formed between shirttail ring 60 and adjacent portions inside surface 26. Clearance gap 66 is also formed between shirttail ring 60 and backface surface 40 as part of this opening to outer segment 52.

As best shown in FIG. 3 bearing 44 is disposed within the gap between exterior surface 48 of spindle 28 and interior surface 46 of cavity 42. Seal element 54 is disposed between the exterior of spindle 28 and the interior of cavity 42 axially spaced from bearing 44. Seal element 54 is also located within the gap between outer segment 52 and bearing 44 to retain bearing lubricant and to block well fluids and downhole debris from contacting bearing surfaces 46 and 48 which would damage these surfaces and/or bearing 44 leading ultimately to failure of drill bit 10.

As shown in FIGS. 2, 3, and 4, shirttail ring 60 is disposed on the exterior of spindle 28 within the opening formed between backface surface 40 and adjacent portions of inside surface 26 by outer segment 52 of the gap. Shirttail ring 60 is a generally flat, cylindrical disk with inside diameter 62 corresponding approximately with outside diameter portion 63 of spindle 28. Outside diameter 64 of shirttail ring 60 is selected in accordance with the teachings of the present invention to insure that a portion of shirttail ring 60 will extend from bottom edge 32 of shirttail surface 30. Also, outside diameter 64 of shirttail ring 60 is selected to be less than the diameter of backface surface 40 on cutter cone body 34.

Shirttail ring 60 is preferably formed from hard abrasion resistant materials such as cast carbide chips and hard steel, sintered tungsten carbide, or tungsten carbide powder and a suitable binder. Shirttail ring 60 may also be formed from various types of composite and matrix materials. Shirttail ring 60 may be mounted on spindle 28 by various methods including press fit, brazing, and/or various adhesives. Since shirttail ring 60 is a separate component, a wide variety of materials and fabricating techniques may be used to form shirttail ring 60 which would not be suitable materials or techniques for forming support arm 24 and spindle 28 or cutter cone body 34.

On conventional support arms the tip of the associated shirttail surface may have a thickness of only 0.032 inches to 0.125 inches. This relatively thin portion makes the application of hard metal or hard facing difficult and substantially limits the amount of protective hardfacing which may be applied to the shirttail surface of conventional support arms. The present invention allows shirttail ring 60 to be formed from material which is substantially harder than the steel alloys used to form support arm 24 and spindle 28. The dimensions and configuration of shirttail ring 60 may be varied as desired to minimize manufacturing costs while optimizing downhole performance of the associated drill bit 10. For example, the shirttail ring 60 may vary in thickness from 0.1 to 0.15 inches. Depending on the type of materials used to form shirttail ring 60 the thickness could be either substantially decreased or increased as desired.

For the embodiment shown in FIGS. 2, 3 and 4, first radius 65 is formed at the junction between the upper portion of spindle 28 and inside surface 26 of support arm 24. A corresponding second radius 67 is preferably formed as part of inside diameter 62 of shirttail ring 60. First radius 65 and second radius 67 cooperate with each other to minimize stress at the junction of spindle 28 and inside surface 26.

For some applications, chamfered surface 68 may be formed as part of outside diameter 64 on the exterior of shirttail ring 60. The dimensions of shirttail ring 60 and the associated support arm 24 and cutter cone assembly 12 may be selected such that chamfered surface 68 of shirttail ring 60 will be aligned approximately parallel with the inside diameter of the well bore formed by drill bit 10. Chamfered surface 68 results in increased wear resistance and increased resistance to fracture of the associated shirttail ring 60.

The dimensions of shirttail ring 60 including outside diameter 64 are preferably selected to position the portion of chamfered surface 68 exposed at outer segment 52 approximately parallel with and extending radially from the associated shirttail surface 30. The dimensions of shirttail ring 60 including outside diameter 64 are also selected to ensure that chamfered surface 68 does not extend beyond the gauge diameter for the resulting well bore as defined by the exterior of base 36 of cutter cone body 34. Thus, the present invention allows optimizing the materials used to form shirttail ring 60, the thickness of shirttail 60 and the location of chamfered surface 68 to maximize the erosion protection provided for the associated support arm 24 and cutter cone assembly 12.

Figure 5:
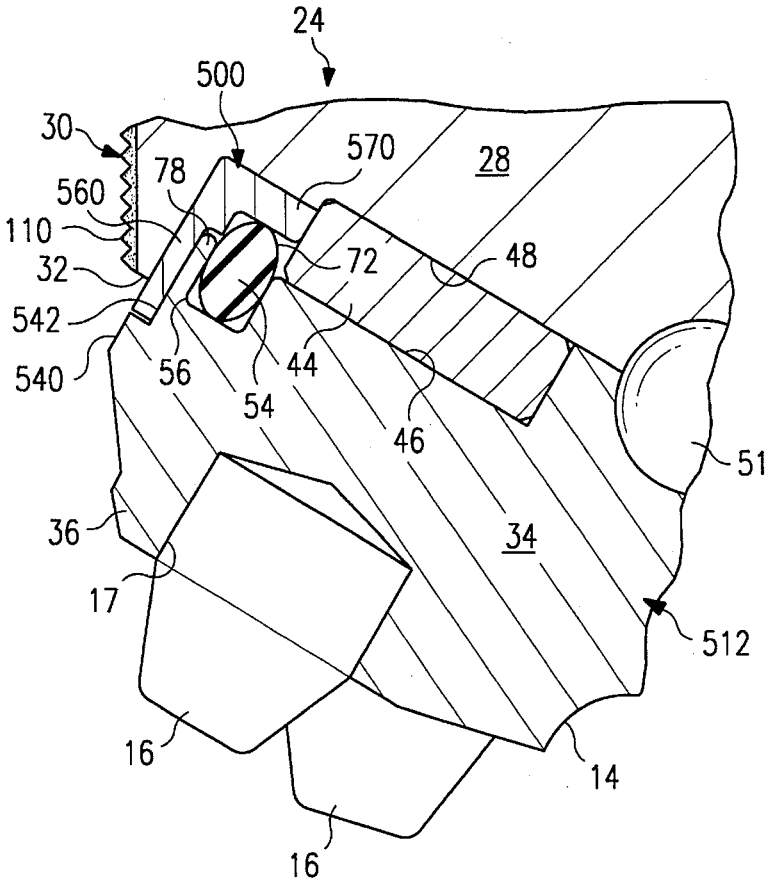
FIG. 5 is an enlarged drawing in section showing portions of a support am and cutter cone assembly incorporating an alternative embodiment of the present invention.
Figure 6:
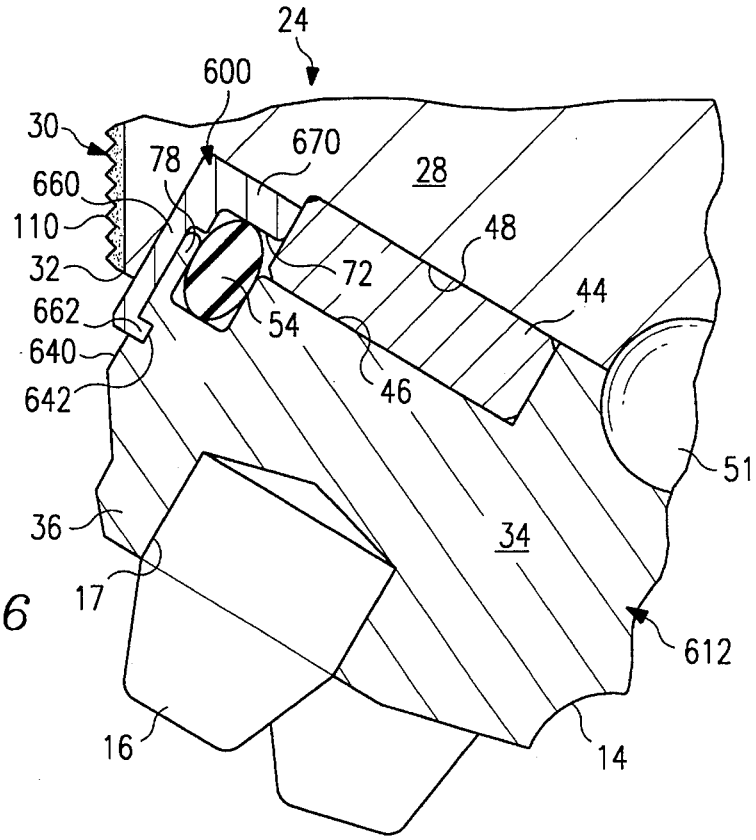
FIG. 6 is an enlarged drawing in section with portions broken away showing a support arm and cutter cone assembly incorporating another embodiment of the present invention.
Figure 7:
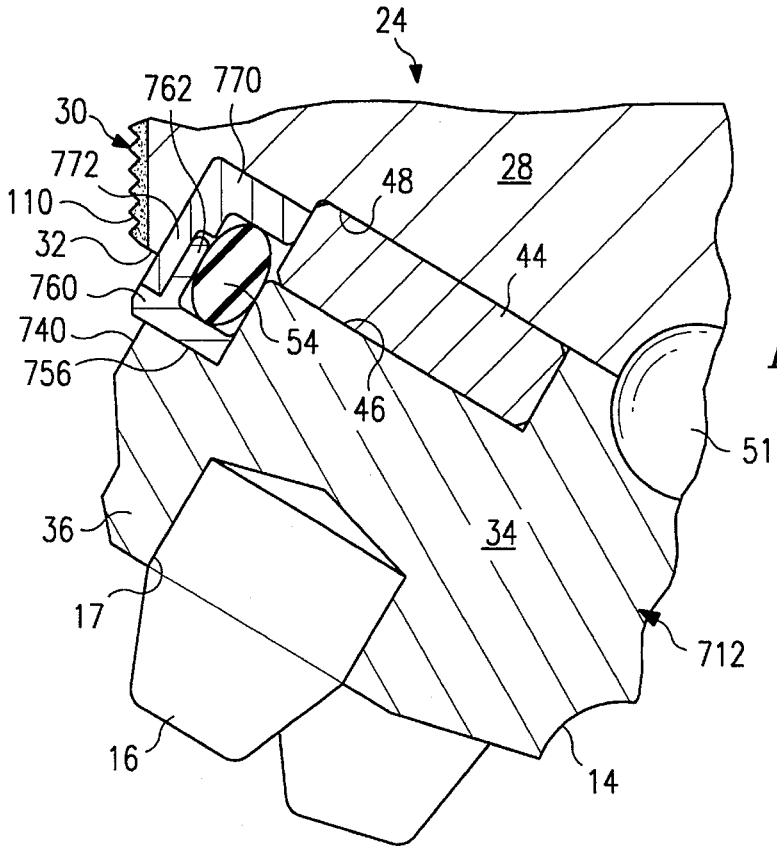
FIG. 7 is an enlarged drawing in section with portions broken away showing a support arm and cutter cone assembly incorporating a further embodiment of the present invention.

The present invention also allows increasing the thickness of bottom edge 32 and adjacent portions of shirttail surface 30 as compared to conventional support arms. Thus, for some applications, a relatively thick layer of hardfacing 110 may be applied to shirttail surface 30 as shown in FIGS. 5, 6 and 7. Due to this increase thickness, hardfacing 110 may also be applied directly to bottom edge 32. Thus, the embodiment of the present invention as shown in FIGS. 5, 6 and 7 provides additional erosion protection by combining the benefits of the respective shirttail ring with a thick shirttail having relatively thick hardfacing 110 disposed thereon.

Figure 8:
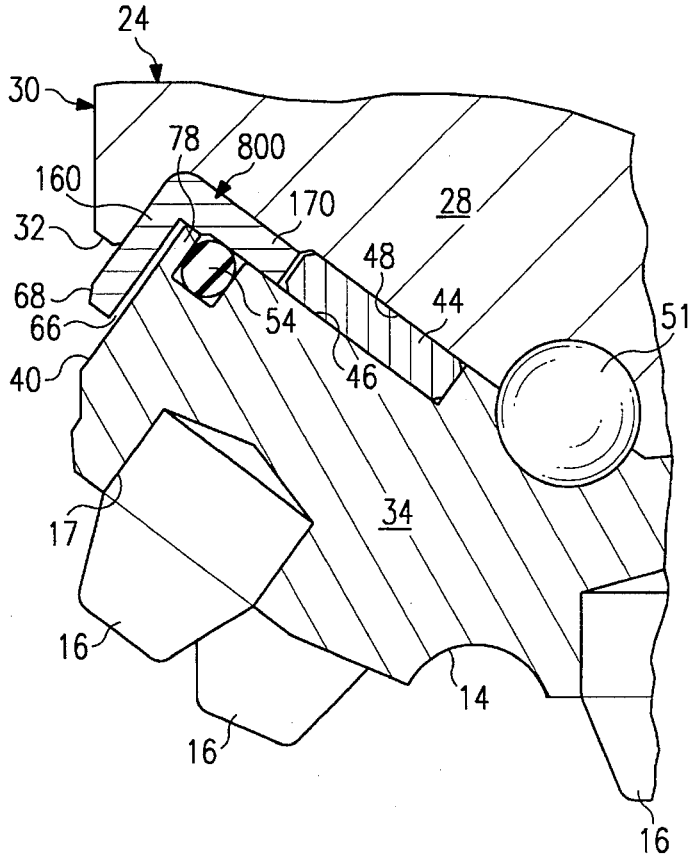
FIG. 8 is an enlarged drawing in section with portions broken away showing a support arm and cutter cone assembly incorporating still another embodiment of the present invention.

As previously noted cutter cone 12 is rotatably mounted on spindle 28. Therefore, sufficient clearance must be provided between cavity 42 and the exterior of spindle 28. For purposes of illustration, clearance gap 66 is shown in FIGS. 3 and 8 between backface surface 40 and the respective shirttail rings 60 and 160. The size of clearance gap 66 is exaggerated in FIGS. 3 and 8 for purposes of illustration. Typically the dimensions of clearance gap 66 will vary from 0 to 0.010 inches. The present invention allows the use of manufacturing techniques to closely control the size of clearance gap 66 within very close tolerances.

As shown in FIGS. 2, 3, and 4 seal ring 70 is preferably disposed on the exterior of spindle 28 in close abutting contact with shirttail ring 60. Inside diameter 72 of seal ring 70 forms a press fit with outside diameter 63 of spindle 28. Outside diameter 74 of seal ring 70 is preferably selected to be substantially less than outside diameter 64 of shirttail ring 60. A significant feature of the present invention includes the ability to form seal ring 70 from various types of material which will enhance the fluid barrier formed with seal element 54. For example, seal ring 70 may be formed from various types of high alloy steel which are incompatible with the manufacturing techniques associated with support arm 24, spindle 28 and/or cutter cone body 34 or would substantially increase the cost of drill bit 10 if support arm 24 and cutter cone 12 assembly were fabricated from such high alloy steel. Thus, outside diameter 74 of seal ring 70 provides an enhanced sealing surface to form the desired fluid barrier with seal element 54 while allowing rotation of cutter cone 12 relative to spindle 28.

For some applications it may be desirable to eliminate seal ring 70 and to use a larger seal element to form the fluid barrier directly between the interior of cavity 42 and the adjacent outside diameter of spindle 28. Seal element 54 may be disposed within annular seal groove 56 formed on the interior of cavity 42. Groove 56 is preferably disposed opposite from sealing surface 74. The present invention allows optimizing the materials and fabrication techniques associated with shirttail ring 60 and seal ring 70 and their respective geometry to maximize the downhole performance of the resulting drill bit 10 while minimizing manufacturing costs.

For the embodiment of the present invention shown in FIGS. 2, 3, and 4 groove 56 is formed within cavity 42 spaced axially from backface surface 40. This configuration provides flange 78 between seal element 54 and shirttail ring 60. Flange 78 protects seal element 54 from the hard abrasive materials associated with shirttail ring 60 and thus increases the down hole service life for seal element 54.

For some applications it may be preferable to form shirttail ring 60 and seal ring 70 as a single component. Examples of this embodiment are shown in FIGS. 5, 6 and 8. In FIG. 5 cutter cone 512 is essentially the same as previously described cutter cone 12 except for annular recess 542 formed in backface surface 540. The dimensions of annular recess 542 are preferably selected to accommodate shirttail portion 560 of ring 500. Seal ring portion 570 of ring 500 is essentially the same as previously described seal ring 70. Since shirttail ring portion 560 and seal ring portion 570 are formed as part of a single ring 500, less abrasive materials may be used for some applications to provide a suitable sealing surface 72.

Cutter cone 612 and ring 600 as shown in FIG. 6 are essentially the same as previously described cutter cone 512 and ring 500 except for the following differences. Backface surface 640 of cutter cone 612 includes an annular recess 642. Shirttail protection portion 660 of ring 600 preferably includes an annular lip 662 sized to be received within annular recess 642. Annular recess 642 and lip 662 cooperate with each other to provide a tortious path for any fluids or well debris entering the gap formed between the interior of cutter cone 612 and the exterior of spindle 28.

Cutter cone 712 as shown in FIG. 7 is essentially the same as previously described cutter cone 12 except for an enlarged annular recess 756 which extends from backface surface 740 to approximately the location of bearing surface 46. A pair of interconnecting rings 760 and 770 are shown in FIG. 7. Backface or mating ring 760 may be secured within recess 756 by various techniques including press fitting, welding and/or adhesives. In a similar manner, ring 770 may be attached to spindle 28 as previously described. Seal element 54 is preferably disposed within a cavity defined by backface ring 760 and ring 770. The overlapping portions 762 and 772 of the respective rings 760 and 770 provide a hardened, tortuous path for fluid flow from the exterior of the associated drill bit 10. The inside diameter of rings 760 and 770 preferably include an appropriate sealing surface to form a fluid barrier with seal element 54.

To help protect against erosion of support arm 24, shirttail surface 30 including bottom edge 32 may be covered with layer 110 of conventional hardfacing material. Such hardfacing material may comprise tungsten carbide particles dispersed within a cobalt, nickel, or iron based alloy matrix, and may be applied using fusion welding processes or other suitable techniques associated with the manufacture of downhole drill bit. Acceptable alternative hardfacing materials include carbides, nitrides, borides, carbonitrides, silicides of tungsten, niobium, vanadium, molybdenum, silicon, titanium, tantalum, hafnium, zirconium, chromium or boron, diamond, diamond composites, carbon nitride, and mixtures thereof.

In accordance with perhaps a broader and more important aspect of the present invention as illustrated in FIG. 4, shirttail ring 60 may be a composite material formed separately from seal ring 70, spindle 28 and cutter cone 12 and includes a nonheat-treatable hard metal component having a higher degree of hardness than found in prior support arms and cutter cone assemblies. In contrast, support arm 24 and cutter cone 12 may be made of a conventional heat-treated steel. With this construction, shirttail ring 60 is better able to withstand both erosion and abrasive wear, thus providing enhanced erosion protection.

Alternatively, shirttail ring 60 may be made as a casting of composite materials including hard particles, such as boron carbide ($B_4C$), silicon nitride ($Si_3N_4$), or silicon carbide (SiC), in a tough ferrous matrix such as a high strength, low alloy steel, or precipitation hardened stainless steel. In the form of fibers or powders, these particles can reinforce such a matrix. This matrix may be formed either by mixing the particles with the molten alloy and casting the resultant slurry, or by making a preform of the particles and allowing the molten alloy to infiltrate the preform.

For some applications, ring 800, as shown in FIG. 8, may be cast as a single piece with seal ring portion 170 formed from alloy steel to provide an appropriate sealing surface for seal element 54. Shirttail ring portion 160 may be formed from the previously noted hard materials to provide enhanced erosion protection. Using composite material casting techniques allows optimizing the performance of ring 800, while reducing manufacturing costs.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, the drill bit comprising:

a bit body with an upper end portion adapted for connection to a drill string for rotation about a longitudinal axis of the bit body;

a number of angularly-spaced support arms integrally formed with the bit body and depending therefrom, each of the support arms having an inside surface with a spindle connected thereto and an outer shirttail surface;

each spindle projecting generally downwardly and inwardly with respect to the longitudinal axis of the bit body and having a generally cylindrical upper end portion connected to the inside surface of the respective support arm;

a plurality of cutter cones equaling the number of support arms and rotatably mounted on one of the respective spindles;

each of the cutter cones including an internal generally cylindrical cavity for receiving the respective spindle;

a generally cylindrical gap formed between the exterior of each spindle and interior of each cavity, the gap having an outer segment extending radially outward from the exterior of the spindle and intersecting with the shirttail surface to form an opening;

a bearing element disposed within each gap between the exterior of the respective spindle and the interior of the respective cavity;

a seal element disposed within each gap and sealing between the respective spindle and the interior of the respective cavity;

a shirttail ring disposed on the exterior of each spindle adjacent to the respective inside surface and located within the opening to the respective gap, the shirttail ring operable to provide erosion protection; and a portion of each shirttail ring extending from the bottom edge of the respective shirttail surface.

2. The drill bit as defined by claim 1 wherein each cutter cone further comprises:

a generally conical cutter cone body having a base with an opening to the cavity formed therein and a nose pointed away from the cavity opening;

each base having a backface surface compatible with the associated shirttail ring to allow rotation of each cutter cone with respect to its associated spindle; and each shirttail ring disposed between the respective backface surface of the base and the inside surface of the respective support arm.

3. The drill bit as defined in claim 1 wherein each cutter cone further comprises:

a generally conical cutter cone body formed from conventional steel material; and the shirttail ring formed from hard metal material incompatible with material requirements and machining processes for the support arms.

4. The drill bit as defined by claim 1 further comprising hard metal surfaces formed on the shirttail surface adjacent to the exposed portion of the shirttail ring.

5. The drill bit as defined by claim 1 further comprising:

each cutter cone having a base with an opening to the cavity formed therein and a nose pointed away from the cavity opening;

a groove formed within the cavity adjacent to the opening and the seal element disposed within the groove; and a seal ring disposed on the exterior of the spindle with one end of the seal ring located adjacent to the shirttail ring and the exterior of the seal ring contacting the seal element.

6. The drill bit as defined in claim 1 further comprising:

a seal ring disposed on the exterior of each spindle adjacent to the shirttail ring; and the seal ring having a smooth outside diameter to form a fluid barrier with the seal element.

7. The drill bit as defined by claim 6 further comprising each seal ring having an inside diameter which forms a fluid barrier with the adjacent surface of the spindle.

8. The drill bit as defined by claim 1 further comprising a seal ring formed as an integral part of the shirttail ring with the seal ring having an outside diameter disposed adjacent to the seal element.

9. The drill bit as defined by claim 1 further comprising:

a first radius formed at the junction of the generally cylindrical upper end portion of the spindle and the adjacent inside surface of the respective support arm;

each shirttail ring having an inside diameter with a second radius formed on a portion of the inside diameter; and the first radius of the support arm corresponding approximately with the second radius formed on the inside diameter of the respective shirttail ring.

10. The drill bit as defined by claim 1 wherein the shirttail ring further comprises:

an outside diameter extending from a portion of the shirttail surface; and a chamfer formed on the outside diameter of the shirttail ring.

11. A support arm and cutter cone assembly for a rotary cone drill bit having a bit body comprising:

a support arm formed to extend from the bit body and having an inside surface, an outer shirttail surface, and a bottom edge, the inside surface and the shirttail surface contiguous at the bottom edge;

a spindle attached to the inside surface and angled downwardly with respect to the support arm;

a cutter cone having a first opening with a cavity extending therefrom to receive the spindle therein;

a generally cylindrical gap formed between the exterior of the spindle and the interior of the cavity, the gap having an outer segment extending radially from the exterior of the spindle and intersecting the bottom edge of the shirttail surface to form a second opening;

a bearing disposed within the gap between the exterior of the spindle and the interior of the cavity;

a seal element disposed within the gap to form a fluid barrier between the spindle and the interior of the cavity;

a shirttail ring disposed on the exterior of the spindle adjacent to the inside surface of the support arm within the outer segment of the gap, the shirttail ring operable to provide erosion protection; and a portion of the shirttail ring extending from the bottom edge of the shirttail surface to prevent erosion of the associated cutter cone.

12. The assembly of claim 11 wherein the cutter cone further comprises:

a generally conical cutter cone body having a base with the first opening to the cavity formed therein and a nose pointed away from the cavity opening;

the base having a backface surface compatible with the associated shirttail ring to allow rotation of the cutter cone with respect to the spindle;

the shirttail ring disposed over the backface surface of the base to prevent erosion;

an annular real groove formed in the cavity and spaced axially from the backface surface to form a flange between the groove and the backface surface; and the seal element disposed within the annular real groove with the flange preventing contact between the shirttail ring and the real element.

13. The assembly of claim 11 wherein the cutter cone further comprises:

a generally conical cutter cone body formed from conventional steel material; and the shirttail ring formed in part from carbide material incompatible with fabrication techniques associated with the respective support arm.

14. The assembly of claim 11 wherein the shirttail surface of the support arm and the cutter cone have hard metal surfaces adjacent to the second opening and the shirttail ring disposed therebetween to further minimize erosion of the shirttail surface and the cutter cone.

15. The assembly of claim 11 further comprising:

the cutter cone having a base with the first opening to the cavity formed therein and a nose pointed away from the cavity opening;

a backface surface formed on the base with an annular recess formed therein to receive a portion of the associated shirttail ring.

16. The assembly of claim 11 further comprising:

the shirttail ring disposed on the exterior of the spindle adjacent to the inside surface of the support arm;

a backface ring disposed within a recess formed in the backface surface of the cutter cone body;

a first sealing surface formed as an integral part of the shirttail ring;

a second sealing surface formed as an integral part of the backface ring; and the seal element disposed between the respective sealing surface.

17. A method of fabricating a rotary cone drill bit used to form a borehole, comprising the steps of:

forming a bit body having an upper portion adapted for connection to a drill string to rotate the bit body;

forming a plurality of angularly spaced support arms extending from the bit body with each support arm having an inside surface;

forming a spindle on each inside surface projecting generally downwardly and inwardly with respect to its associated support arm;

forming a plurality of cutter cones equal to the number of support arms;

forming a plurality of shirttail rings equal to the number of support arms and placing one of the shirttail rings on the exterior of each spindle adjacent to the respective inside surface; and mounting each cutter cone on its respective spindle with a generally cylindrical gap formed between the exterior of the spindle and the interior of the respective cutter cone with a portion of each shirttail ring extending from the bottom edge of the respective shirttail surface through an opening formed by the gap.

18. The method of claim 17 further comprising the steps of:

forming a plurality of seal rings equal to the number of support arms and placing one of the seal rings on the exterior of each spindle adjacent to the respective shirttail ring; and installing a seal element on the interior of each cutter cone adjacent to the seal ring to form a fluid barrier within the generally cylindrical gap.

19. The method of claim 17 further comprising the step of forming a seal ring as an integral part of the shirttail ring.

20. The method of claim 17 further comprising the steps of forming a shirttail ring for each spindle and a backface ring for each cutter cone with portions of the shirttail ring and the backface ring disposed adjacent to each other to form a hardened, tortuous path to restrict fluid flow from the opening into the gap.

* * * * *